US008860618B2

(12) United States Patent
Gertenbach et al.

(10) Patent No.: US 8,860,618 B2
(45) Date of Patent: Oct. 14, 2014

(54) INTERNAL FM ANTENNA

(75) Inventors: Johan Lucas Gertenbach, Cambridge (GB); James Digby Yarlet Collier, Suffolk (GB)

(73) Assignee: Cambridge Silicon Radio Limited, Cambridge (GB)

( * ) Notice: Subject to any disclaimer, the term of this patent is extended or adjusted under 35 U.S.C. 154(b) by 636 days.

(21) Appl. No.: 13/146,616

(22) PCT Filed: Jan. 11, 2010

(86) PCT No.: PCT/EP2010/050218
§ 371 (c)(1),
(2), (4) Date: Feb. 7, 2012

(87) PCT Pub. No.: WO2010/086208
PCT Pub. Date: Aug. 5, 2010

(65) Prior Publication Data

US 2012/0127047 A1 May 24, 2012

(30) Foreign Application Priority Data

Jan. 30, 2009 (GB) ..... 0901583.5

(51) Int. Cl.

| | |
|---|---|
| ***H01Q 9/00*** | (2006.01) |
| ***H01Q 1/40*** | (2006.01) |
| ***H01Q 1/22*** | (2006.01) |
| ***H01Q 1/24*** | (2006.01) |
| ***H01Q 1/36*** | (2006.01) |
| ***H01Q 7/08*** | (2006.01) |
| ***H01Q 9/28*** | (2006.01) |
| ***H01Q 9/30*** | (2006.01) |

(52) U.S. Cl.
CPC ..... *H01Q 1/40* (2013.01); *H01Q 1/2283* (2013.01); *H01Q 1/243* (2013.01); *H01Q 1/36* (2013.01); *H01Q 7/08* (2013.01); *H01Q 9/285* (2013.01); *H01Q 9/30* (2013.01)
USPC ..... 343/745

(58) Field of Classification Search
USPC ..... 343/745, 895, 700 MS, 802
See application file for complete search history.

(56) References Cited

U.S. PATENT DOCUMENTS

| | | | | |
|---|---|---|---|---|
| 4,407,000 | A | 9/1983 | Sasaki et al. | |
| 6,169,523 | B1 * | 1/2001 | Ploussios | 343/895 |
| 2003/0054855 | A1 | 3/2003 | Kojola et al. | |
| 2004/0199071 | A1 * | 10/2004 | Lardo et al. | 600/423 |
| 2006/0262030 | A1 * | 11/2006 | Bae et al. | 343/895 |
| 2009/0156151 | A1 | 6/2009 | Anguera et al. | |
| 2009/0195472 | A1 | 8/2009 | Rambeau et al. | |

* cited by examiner

*Primary Examiner* — Thien M Le
(74) *Attorney, Agent, or Firm* — Fulbright & Jaworski LLP

(57) ABSTRACT

An antenna for receiving and/or transmitting radio frequency signals in a predetermined frequency band, the antenna comprising: a first antenna portion comprising at least one conducting loop about a first material having an initial permeability of at least 4; and a second antenna portion embedded within a second material having a dielectric constant of at least 4; wherein the first and second antenna portions are electrically coupled together so as to form a compound antenna having a size such that the diameter of the smallest sphere which encloses all of the first and second antenna portions of the compound antenna is less than 1/30 of the wavelength of the radio frequency signals at the center of the predetermined frequency band.

33 Claims, 3 Drawing Sheets

INTERNAL FM ANTENNA

BACKGROUND OF THE INVENTION

This invention relates to antennas for receiving and/or transmitting radio frequency signals, and in particular, to antennas configured in a space-efficient manner.

It is common for the signal processing components of a radio transceiver to be implemented in a single integrated circuit so as to allow the provision of a radio receiver in small portable devices, such as mobile telephones and media players. However, in order to achieve an acceptable signal quality over the commercial FM band (76 MHz to 108 MHz) it has been necessary to continue to use an external antenna. This is a result of the relatively long wavelength at these frequencies (approximately 3 meters) which is much larger than the typical size of a mobile phone or media player (8 to 15 cm). Simply shrinking a conventional antenna design so that it will fit inside a portable device leads to a very large loss in efficiency and a significant reduction in the bandwidth of the antenna. These problems are discussed in a paper by D. Aguilar et al entitled "Small handset antenna for FM reception", published in Microwave and Optical Technology Letters, Vol. 50, No. 10 (October 2008). The paper also proposes some improved space-efficient antenna designs based around loop antenna configurations.

For some devices, using an external antenna is not a significant problem since conductive components of the device that are otherwise present to serve another function can be used as the antenna. For example, in a mobile phone that has a wired headset the cable that connects the phone to the headset can be used as an antenna for receiving frequency modulated (FM) broadcast radio signals in the band 76 MHz to 108 MHz. However, it is becoming increasingly common for wireless headsets to be used with mobile phones which do not provide a cable suitable for use as an antenna. Furthermore, radio reception functionality could be added to many more devices if a long antenna wire were not required.

The problem is particularly critical for the relatively long wavelength radio signals in the commercial FM band, but analogous miniaturisation problems apply in other radio frequency bands where it is desirable to embed an antenna within a small integrated circuit or restricted space.

There is therefore a need for a space-efficient antenna structure which allows a radio frequency antenna to be embedded within a device or integrated circuit.

SUMMARY OF THE INVENTION

According to a first aspect of the present invention there is provided an antenna for receiving and/or transmitting radio frequency signals in a predetermined frequency band, the antenna comprising: a first antenna portion comprising at least one conducting loop about a first material having an initial permeability of at least 4; and a second antenna portion embedded within a second material having a dielectric constant of at least 4; wherein the first and second antenna portions are electrically coupled together so as to form a compound antenna having a size such that the diameter of the smallest sphere which encloses all of the first and second antenna portions of the compound antenna is less than 1/30 of the wavelength of the radio frequency signals at the centre of the predetermined frequency band.

Suitably the first and second antenna portions substantially lie in a common plane. One end of the first or second antenna portions may be terminated at ground. The second antenna portion may be a monopole antenna. The second antenna portion may be configured as one of a meandering line, a fractal curve and a straight line.

Suitably the antenna is configured in a balanced antenna arrangement. Suitably the antenna further comprises a third antenna portion identical to the second antenna portion and electrically coupled to the first antenna portion so as to form a dipole antenna.

Preferably the antenna portions are formed from one or more conductive wires, printed conductor segments or conductive tracks formed by deposition.

Preferably the first and second materials are one and the same core material. Preferably said core material is elongate in shape and the at least one loop of the first antenna portion is wound about the long axis of the core material. The core material may be approximately cylindrical or oblong. Preferably the first antenna portion comprises a plurality of loops wound about said core material in a solenoid antenna arrangement. Preferably the core material extends along the common axis of the loops of the first antenna portion such that each loop encircles the core material. Preferably the second antenna portion extends along the long axis of the core material, approximately through the centre of the core material. The first and second antenna portions may be electrically connected at one end of the core material.

Suitably the second antenna portion is a conducting element sandwiched between two halves of core material.

Suitably the antenna further comprises an outer material substantially surrounding the core material and the first and second antenna portions, the outer material having an initial permeability of at least 1 and a dielectric constant of at least 4.

The core material may be a ferrite or ceramic.

Preferably the antenna is connected to an integrated circuit comprising tuning circuitry configured to perform impedance tuning of the antenna. Preferably the tuning circuitry comprises one or more switched or variable capacitors.

Suitably the antenna has a plurality of antenna connections at different positions along the first antenna portion so as to provide a plurality of selectable antenna impedances. Alternatively, connection to the antenna is by means of one or more conducting loops magnetically coupled to the antenna.

Preferably the antenna is provided in a single package for connection to a printed circuit board.

Suitably the antenna is provided in a portable device. Preferably the wavelength of the radio frequency signals at the centre of the predetermined frequency band is approximately the wavelength at which the antenna is resonant in situ in the portable device.

The radio frequency signals may be frequency modulated signals having a frequency in the range 76 to 108 MHz. Preferably the bandwidth of the antenna is at least 300 kHz.

Preferably the initial permeability of the first material is at least 6 substantially across the predetermined frequency band. Preferably the dielectric constant of the second material is greater than 6.

According to a second aspect of the present invention there is provided an integrated circuit comprising an antenna as claimed in any preceding claim.

Preferably the integrated circuit further comprises tuning circuitry configured to perform impedance tuning of the antenna. Suitably the integrated circuit further comprises circuitry for performing processing in accordance with the IEEE 802.11 and/or Bluetooth communication protocols.

According to a third aspect of the present invention there is provided an antenna system for receiving and/or transmitting radio frequency signals in a predetermined frequency band, the antenna system comprising: an antenna having first and second antenna portions electrically connected together, the first antenna portion comprising at least one conducting loop about a first material having an initial permeability of at least 4, and the second antenna portion being embedded within a second material having a dielectric constant of at least 4; a ground plane electrically connected to the antenna; and tuning circuitry having variable impedance and electrically coupled to the antenna so as to allow tuning the resonant frequency of the oscillatory system comprising the antenna, ground plane and tuning circuitry; wherein the size of the antenna is such that the diameter of the smallest sphere which encloses all of the first and second antenna portions of the antenna is less than 1/30 of the wavelength of the radio frequency signals over the range of radio frequency signals at which the oscillatory system is resonant.

DESCRIPTION OF THE DRAWINGS

The present invention will now be described by way of example with reference to the accompanying drawings, in which.

DETAILED DESCRIPTION OF THE DRAWINGS

The following description is presented to enable any person skilled in the art to make and use the invention, and is provided in the context of a particular application. Various modifications to the disclosed embodiments will be readily apparent to those skilled in the art.

The general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

The most simple form of resonant antenna is a monopole antenna of approximate length $\lambda/4$, where $\lambda$ is the wavelength of the radio frequency signals that are to be received. For radio signals in the FM band, this length is of the order of 800 mm and therefore impractical to be incorporated within a typical portable device. However, the Chu-Wheeler law relates the size of an antenna to the Q-factor of the antenna and shows that an antenna can be shrunk in size at the expense of the bandwidth of the antenna and without (theoretically) affecting the efficiency of the antenna. In practice, the efficiency is markedly affected by packing an antenna into a small space in a device because of losses (resistive, dielectric and/or magnetic) in the antenna, as well as losses in matching components. For an electrically small antenna the radiation resistance is often very small compared to the equivalent series loss resistance in the antenna elements. In addition, near field energy is dissipated in absorptive bodies (the human body, conductive objects, etc.).

The present invention recognises that, providing that the bandwidth of the antenna is at least the bandwidth of the radio signal that is to be received/transmitted, a small antenna can be used to receive/transmit signals across a frequency band by tuning the resonant frequency of the antenna. The present invention further recognises that the efficiency of a small antenna can be maintained by using an antenna having magnetic and electrostatic parts that allow the antenna to reduce the effect of near-field clutter and improve beneficial coupling between the antenna and a human body in close proximity.

Figure 1:
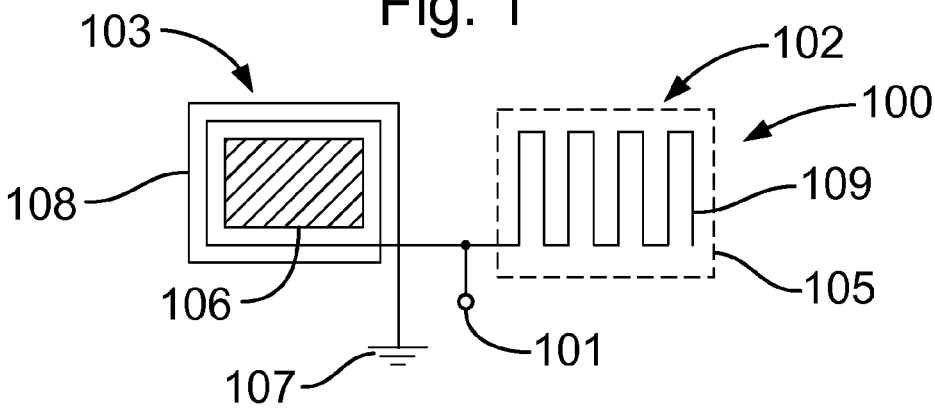
FIG. 1 is a schematic diagram of an unbalanced antenna according to the present invention.

FIG. 1 shows an unbalanced antenna configured in accordance with the present invention. The antenna 100 comprises two parts: a magnetic part 103 having a conducting loop 108 wound about a soft magnetic material 106, and an electrostatic part 102 having a monopole antenna 109 embedded within or carried upon a material 105 of high dielectric constant (a "high-k" material). The magnetic and electrostatic antenna parts both feed antenna connection 101, to which a suitable radio receiver can be connected. The remote end of conducting loop 108 is connected to ground—in the case of a portable device, this is typically the ground plane or casing of the device. For a balanced antenna the remote end of conducting loop 108 provides a second connection to the antenna.

Conducting loop 108 of the magnetic part has one or more antenna loops, and preferably two or more. The loops encircle a soft magnetic material 106, such as ferrite, having an initial permeability of at least 4, and preferably in the range 10 to 30. It is advantageous in terms of radiation coupling if magnetic material 106 fills as much of the volume defined by the encircling antenna loops as possible. It is further preferable if material 106 extends perpendicular to the plane of conducting loops 108 such that all points along the loops encircle material 106. The conducting loops 108 can be of any shape: for example, a square, circular, fractal and may define a spiral or helix about material 106.

Monopole antenna 109 may adopt any configuration: for example, a line, fractal or meander pattern, or a solenoid arranged about material 105. It is advantageous in terms of radiation efficiency if antenna portion 109 is at least partially embedded in electrostatic material 105. Alternatively, antenna portion 109 may be arranged on the surface of material 105. So as to minimise the size of the antenna it is preferable that the antenna forms a meander pattern as shown in FIG. 1.

Figure 2:
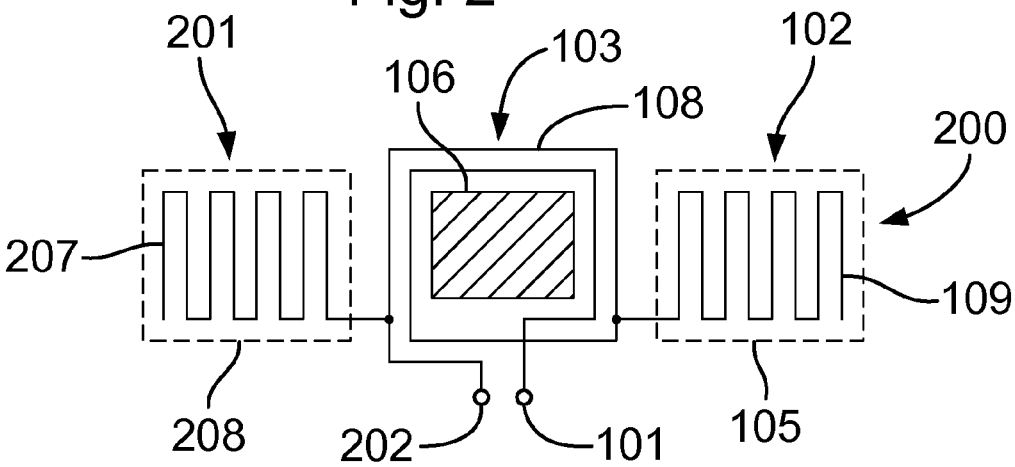
FIG. 2 is a schematic diagram of a balanced antenna according to the present invention.

FIG. 2 shows a balanced antenna 200 configured in accordance with the present invention. Instead of one end of conducting loop 108 being grounded, radio receiver circuitry is presented with two differential antenna connections 101 and 202. Along with antenna portion 109, conducting loop 108 feeds antenna connection 101, as in the unbalanced case. The remote end of conducting loop 108 feeds the second antenna connection 202. So as to further improve the performance of the antenna, it is advantageous if an additional electrostatic antenna part 201 is provided, identical to part 102 and feeding the second antenna connection 202. Arranged in this manner, electrostatic antenna portions 207 and 109 form a dipole antenna.

Preferably, balanced antenna 200 is symmetrical about the antenna portion 108, as shown in FIG. 2. However, this need not be the case and electrostatic antenna portions 207 and 109 may be connected at any point to conducting loop 108. Antenna portions 207, 108 and 109, high-k materials 207 and 109, and magnetic material 106 may have any of the structures and configurations as described above.

Figure 3:
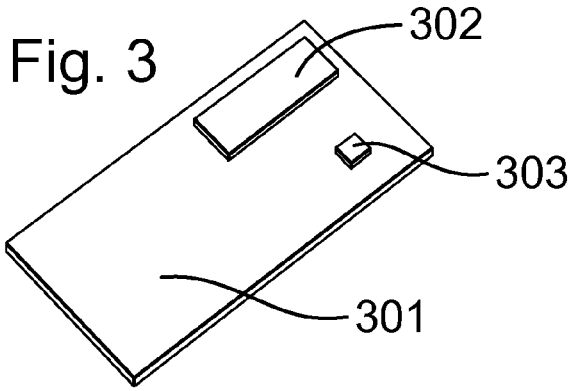
FIG. 3 is a schematic diagram of a printed circuit board suitable for use in a portable device carrying a integrated circuit incorporating an antenna in accordance with the present invention.

By allowing an FM antenna to be shrunk down to a fraction of the received wavelength, an antenna configured in accordance with the present invention can be incorporated internally within a portable device, such as a hand-held media player or mobile telephone. An antenna package 302 is shown mounted on a printed circuit board 301 in FIG. 3. Antenna package 302 may comprise receive/transmit and tuning circuitry in an integrated circuit. Alternatively, the receiver/transmitter and/or tuning circuitry may be embodied in a separate chip 303.

It has been found that by combining the electrical and magnetic parts of the antenna, the antenna performance can be improved and/or the size of the antenna can be further reduced. This is achieved through the use of a material having both an initial permeability of greater than 1 and a dielectric constant of greater than 4. Suitable materials include ferrites, such as Material 68 produced by Fair-rite Products Corp, USA.

Antenna structures having a combined electrical and magnetic element in accordance with the principles of the present invention are shown in FIG. 4. Unbalanced antenna 403 in FIG. 4*a* comprises a core material 401 having a high initial permeability and high-k, and which is substantially cylindrical. The first antenna portion 108 is wound about the long axis of core material 401 so as to form a solenoid antenna. The second antenna portion 109 is a straight rod antenna embedded within core material 401 substantially along its central axis. Antenna 403 is shown in cross-section in FIG. 4*b*, and with an optional outer cladding 402 of the core material. The outer cladding further improves the efficiency of the antenna and minimises the de-tuning effects of other bodies in close proximity to the antenna.

For reasons such as ease of manufacturing, antenna package constraints and the size constraints imposed by the device in which the antenna is to be used, other antenna shapes may be used. Core material 401 is not constrained to be substantially cylindrical and may be any shape, although is preferably elongate (e.g. conical, oblong, ellipsoidal) so as to provide a long axis along which solenoid antenna 108 may be wound. The solenoid antenna could be regular or irregular in shape, helical or spiral and comprises at least two turns. Preferably the solenoid antenna is supported at the surface of material 401 but it could be spaced apart from the material by one or more other electrically insulating materials, or an air gap.

Second antenna portion 109 is a conducting material, such as a metal, and may take any of the configurations described above in relation to FIGS. 1 and 2—it need not be a straight rod through the centre of core material 401.

Figure 4A:
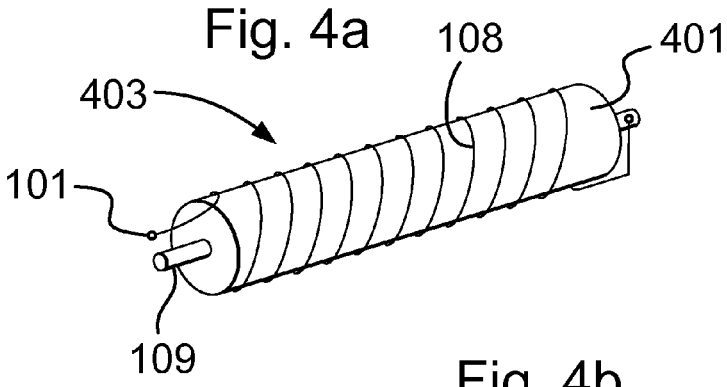
FIG. 4*a* is a schematic diagram of a solenoid antenna according to the present invention.
Figure 4B:
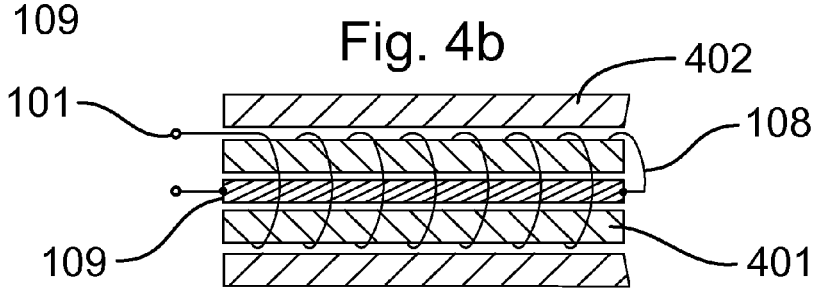
FIG. 4*b* is a schematic diagram of a solenoid antenna according to the present invention shown in cross section and having an optional outer cladding.
Figure 4C:
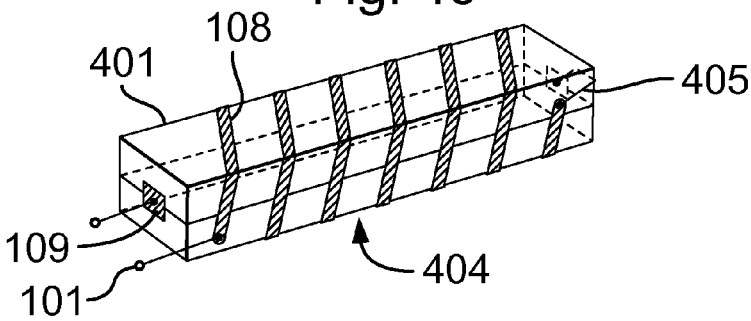
FIG. 4*c* is a schematic diagram of a square-cross-section solenoid antenna according to the present invention.

By way of further example, an antenna 404 having a rectangular cross-section is shown in FIG. 4*c*. Core material 401 comprises two halves which form a sandwich about second antenna portion 109, which could be any kind of conducting material. First antenna portion 108 is a conducting tape wrapped about the core material so as to form the solenoid antenna. An electrical connection between the first and second antenna portions is made at one end of the antenna structure by means of wire 405, or other electrically connective means. Further wires may be used to provide electrical connections to the first and second antenna portions. Antenna 404 has the advantage that it is straightforward to manufacture from two pieces of ferrite pressed together about a conducting metal rod (for example), and can be readily incorporated into a compact package suitable for use in a portable device.

Figure 4D:
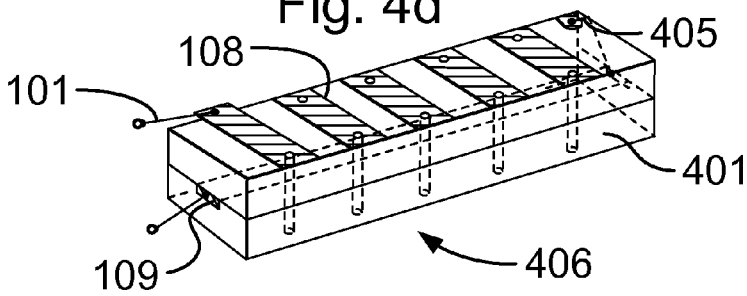
FIG. 4*d* is a schematic diagram of a square-cross-section solenoid antenna according to the present invention suitable for fabrication using printed conductor techniques.

Another example of an antenna having a rectangular cross-section is shown in FIG. 4*d*. Antenna 406 is made in a planar manner, with core material 401 being formed from two blocks of material. Prior to bonding the core material together, a conducting track is printed or deposited (e.g. by photolithograpy) in a groove running approximately along the centreline of a surface of one or both of the two halves of the core material such that, when bonded together, the conducting track forms a conducting rod along the centre of the core material. Conducting tracks 108 are similarly printed on the top and bottom of the core material and joined by conductive vias formed through the two blocks. This antenna configuration has the advantage that it is less expensive to print conductor segments forming the antenna portions than it is to fabricate complex three-dimensional antenna structures using conventional wires and wound metal tracks.

Figure 5A:
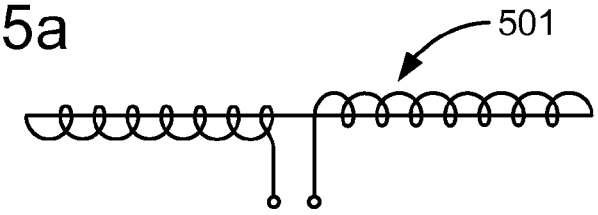
FIGS. 5*a*, 5*b* and 5*c* illustrate different arrangements of a solenoid antenna having a dipole configuration.
Figure 5B:
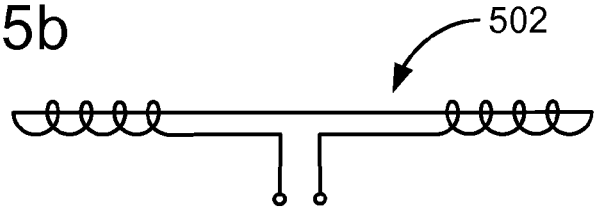
Figure 5C:
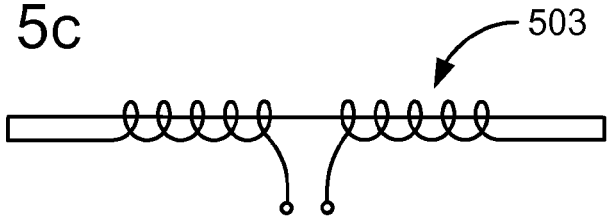

Examples of various dipole antenna configurations of an antenna in accordance with the present invention are shown in FIG. 5. FIG. 5*a* shows a dipole antenna comprising two solenoid first antenna portions and a common second antenna portion. FIGS. 5*b* and 5*c* show a dipole antenna having solenoid antenna portions which do not extend over the entire length of the second antenna portion. In these configurations, the second antenna portions can be stretched over the entire length of the device in which the antenna is being used. The core material around which the solenoid is wrapped may or may not extend over a greater proportion of the second antenna portion than the loops of the solenoid. In FIG. 5*b*, the solenoid does not extend over the central part of the second antenna portion. In FIG. 5*c*, the solenoid does not extend over the distal parts of the second antenna portion.

In practice, the performance of an antenna is in part also determined by the ground plane and the tuning circuitry with which the antenna interacts. For portable electronic devices such as mobile phones, it has been found that the common ground rail for the electronics of the device serves adequately well as a ground plane. A dedicated ground plane is not therefore usually required for the unbalanced antenna designs of the present invention. The resonant frequency of an antenna is determined in-situ by the system comprising the antenna, ground plane and tuning circuitry. An antenna should therefore be designed such that its resonant frequency lies in or close to the frequency band in which the antenna operates when the antenna is coupled to its tuning circuitry and (if unbalanced) the ground plane.

Using the principles of the present invention, an antenna can be constructed of acceptable efficiency having a largest physical dimension of less than $\lambda/30$ and preferably less than $\lambda/50$ or $\lambda/100$ (where $\lambda$ is the typical wavelength of the frequency band). The largest physical dimension of an antenna is determined by the diameter of the smallest sphere which encloses all conductive parts of the antenna. The sphere does not include the ground plane.

Furthermore, the preferred antenna structures described above with reference to FIG. 4 allow the antenna to be further shrunk down to approximately $\lambda/150$. For commercial band FM radio signals this is an antenna approximately 20 mm in length. The combined size of a ground plane paired with such an antenna in a typical hand-held device (such as a mobile phone) is roughly 100 mm in size. This is to be contrasted with the typical minimum length of a straight dipole antenna of $\lambda/2$, which is approximately 1500 mm for commercial FM signals.

As the size of the antenna decreases, it is essential that the bandwidth of the antenna is at least the bandwidth of any signals that are to be transmitted or received—for commercial FM stations this is typically 300 kHz. In order to cover the typically 30 MHz range of the commercial FM band it is necessary to tune the antenna by adjusting the impedance across the antenna connections. Generally this can be achieved through the use of variable impedance devices connected between the antenna connections, or switching in and out capacitive and inductive elements so as to achieve the required impedance. This has the effect of shifting the resonant frequency of the antenna structure.

Active tuning circuitry configured to tune the antenna within the frequency band of interest is preferably provided in an integrated circuit. The tuning circuitry may be incorporated into an integrated circuit that includes the transmit/receive circuitry. Most straightforwardly, the tuning circuitry comprises a set of one or more switched and variable capacitors which are controlled by the receive/transmit circuitry so as to tune the antenna to the required frequency for receiving/transmitting a given signal. Thus, it is advantageous if the net impedance of the antenna is slightly inductive such that the remaining inductance can be tuned out to the desired degree by the switched and/or variable capacitors provided in the tuning circuitry. Preferably the net impedance presented by the antenna is greater than 1 kOhm.

Figure 6A:
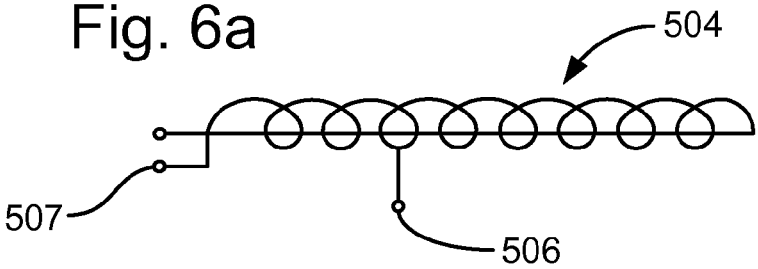
FIG. 6*a* illustrates a tapped solenoid antenna.

Further tuning of the antenna can be achieved through providing multiple connections (or taps) to the one or more loops of the first antenna portion so that, by selecting which connection to the antenna loop to use, the impedance of the antenna can be further adjusted. This helps in allowing an antenna to be tuned across the entire frequency range of interest, and is of particular use with antennas having a very narrow bandwidth. The tuning circuitry therefore preferably further includes one or more switches, controllable by receive/transmit circuitry, so as to allow the appropriate antenna impedance to be selected. An antenna tapped at a point intermediate along the length of the first antenna portion is shown in FIG. 6*a*. Essentially, the antenna presents two different impedances depending on whether the antenna is tapped at connection 507 or connection 506.

With narrow band antennas, dynamic tuning can also be required during the reception or transmission of a radio signal so as to compensate for drift in the receive/transmit circuitry and any changes in the environment of the antenna. Dynamic tuning can be effected by injecting a test signal into the antenna and monitoring the rate of amplitude and phase changes of that signal. As is known in the art, these changes can then be used to dynamically tune the antenna.

Figure 6B:
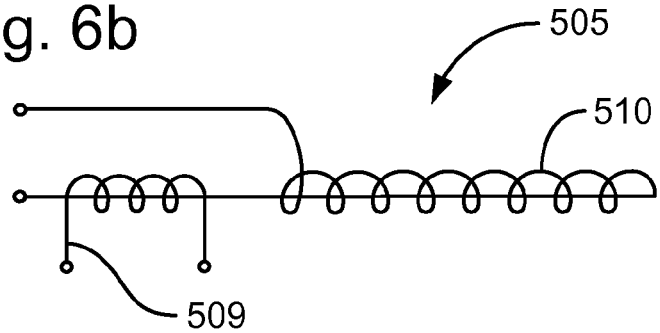
FIG. 6*b* illustrates a solenoid antenna having an inductively-coupled antenna feed.

So as to allow better impedance matching between the antenna and tuning circuitry it can sometimes be useful to use an antenna structure 505 as shown in FIG. 6*b*. A coupling antenna portion 509, to which the tuning circuitry is electrically connected, is magnetically coupled to the antenna 510. Coupling antenna portion 509 may take any configuration but preferably, and as shown in FIG. 6*b*, the coupling antenna portion is a solenoid wound about the second antenna portion.

It is important to recognise that although the resonant frequency of the antenna essentially determines the frequency of signals it can transmit/receive, the antenna may in practice be used to receive/transmit frequencies slightly offset from the resonant frequency of the antenna. Furthermore, the effective resonant frequency of an antenna is not that of the antenna in free space but that of the antenna in-situ connected to its tuning circuitry and surrounded by the components of the device in which it is installed. It is therefore important that the tuning circuitry is configured to take into account the environment in which the antenna is installed.

Good FM reception characteristics from approximately 70 to 120 MHz have been demonstrated using an antenna having a configuration as shown in FIG. 4*a*. The test antenna had a length of 20 mm, diameter 8 mm and a six turn solenoid antenna portion about a ferrite core (Fair-rite material 68) having a 2.5 mm central bore through which the wire of the second antenna portion extends. Such an antenna has a bandwidth of roughly 3-4 MHz. By using a ceramic core having a higher initial permeability (preferably at least 20) and a higher dielectric constant (preferably at least 12), and/or by increasing the number of turns of the solenoid, it is possible to shrink the antenna further. However, changing these parameters in this manner tends to increase the Q-factor of the antenna and hence decrease the bandwidth. This is acceptable providing the bandwidth of the antenna is at least that of the signals which are to be received (at least 300 kHz for commercial FM radio). Such modifications generally require the range over which the tuning circuitry operates to be increased so as to allow the antenna bandwidth to be swept over the entire frequency band. This can be achieved in an integrated circuit through the use of a larger network of variable/switched capacitors and/or through tapping the first antenna portion at various points along its length.

An integrated circuit comprising the tuning and radio receive/transmit circuitry may further comprise processing circuitry and optionally antennas for one or more other radio frequency bands, such as Bluetooth and IEEE 802.11.

Antenna structures in accordance with the present invention have several advantages over conventional antennas. The high-k material concentrates the electric field in the body of the dielectric so that it is less susceptible to external disturbances (such as other components in the device, or dielectric objects/metal surfaces/the human body). This also increases the radiation efficiency of the antenna.

The antenna portions are conductors of any suitable configuration. The antenna portions could be wires arranged appropriately about the electrostatic and magnetic materials. In an integrated circuit, the antenna portions are more suitably tracks printed or deposited by means of known fabrication techniques. Through the use of integrated circuits comprising multiple levels, and mesas interconnecting appropriate features on those levels, complex structures can be built up such as spirals and helices having multiple turns.

The advantages of the present invention are not confined to antennas for the commercial FM band and can be applied across the radio frequency spectrum (such as in the 2.4 GHz ISM band). Above frequencies of approximately 120 MHz it becomes necessary to use core materials other than ferrites.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. An antenna for receiving and/or transmitting radio frequency signals in a predetermined frequency band, the antenna comprising:

a first antenna portion comprising at least one conducting loop about a first material having an initial permeability of at least 4; and a second antenna portion embedded within a second material having a dielectric constant of at least 4;

wherein the first and second antenna portions are electrically coupled together so as to form a compound antenna having a size such that the diameter of the smallest sphere which encloses all of the first and second antenna portions of the compound antenna is less than 1/30 of the wavelength of the radio frequency signals at the centre of the predetermined frequency band.

2. An antenna as claimed in claim 1, wherein the first and second antenna portions substantially lie in a common plane.

3. An antenna as claimed in claim 1, wherein one end of the first or second antenna portions is terminated at ground.

4. An antenna as claimed in claim 1, wherein the second antenna portion is a monopole antenna.

5. An antenna as claimed in claim 1, wherein the second antenna portion is configured as one of a meandering line, a fractal curve and a straight line.

6. An antenna as claimed in claim 1, wherein the antenna is configured in a balanced antenna arrangement.

7. An antenna as claimed in claim 6, further comprising a third antenna portion identical to the second antenna portion and electrically coupled to the first antenna portion so as to form a dipole antenna.

8. An antenna as claimed in claim 1, wherein the antenna portions are formed from one or more conductive wires, printed conductor segments or conductive tracks formed by deposition.

9. An antenna as claimed in claim 1, wherein the first and second materials are one and the same core material.

10. An antenna as claimed in claim 9, wherein said core material is elongate in shape and the at least one loop of the first antenna portion is wound about the long axis of the core material.

11. An antenna as claimed in claim 10, wherein the core material is approximately cylindrical or oblong.

12. An antenna as claimed in claim 10, wherein the first antenna portion comprises a plurality of loops wound about said core material in a solenoid antenna arrangement.

13. An antenna as claimed in claim 12, wherein the core material extends along the common axis of the loops of the first antenna portion such that each loop encircles the core material.

14. An antenna as claimed in claim 10, wherein the second antenna portion extends along the long axis of the core material, approximately through the centre of the core material.

15. An antenna as claimed in claim 14, wherein the second antenna portion is a conducting element sandwiched between two halves of core material.

16. An antenna as claimed in claim 10, wherein the first and second antenna portions are electrically connected at one end of the core material.

17. An antenna as claimed in claim 9, further comprising an outer material substantially surrounding the core material and the first and second antenna portions, the outer material having an initial permeability of at least 1 and a dielectric constant of at least 4.

18. An antenna as claimed in claim 9, wherein the core material is a ferrite or ceramic.

19. An antenna as claimed in claim 1, wherein the antenna is connected to an integrated circuit comprising tuning circuitry configured to perform impedance tuning of the antenna.

20. An antenna as claimed in claim 19, wherein the tuning circuitry comprises one or more switched or variable capacitors.

21. An antenna as claimed in claim 1, wherein the antenna has a plurality of antenna connections at different positions along the first antenna portion so as to provide a plurality of selectable antenna impedances.

22. An antenna as claimed in claim 1, wherein connection to the antenna is by means of one or more conducting loops magnetically coupled to the antenna.

23. An antenna as claimed in claim 1, wherein the antenna is provided in a single package for connection to a printed circuit board.

24. An antenna as claimed in claim 1, wherein the antenna is provided in a portable device.

25. An antenna as claimed in claim 24, wherein the wavelength of the radio frequency signals at the centre of the predetermined frequency band is approximately the wavelength at which the antenna is resonant in situ in the portable device.

26. An antenna as claimed in claim 1, wherein the radio frequency signals are frequency modulated signals having a frequency in the range 76 to 108 MHz.

27. An antenna as claimed in claim 1, wherein the bandwidth of the antenna is at least 300 kHz.

28. An antenna as claimed in claim 1, wherein the initial permeability of the first material is at least 6 substantially across the predetermined frequency band.

29. An antenna as claimed in claim 1, wherein the dielectric constant of the second material is greater than 6.

30. An integrated circuit comprising an antenna as claimed in claim 1.

31. An integrated circuit as claimed in claim 30, wherein the integrated circuit further comprises tuning circuitry configured to perform impedance tuning of the antenna.

32. An integrated circuit as claimed in claim 31, wherein the integrated circuit further comprises circuitry for performing processing in accordance with the IEEE 802.11and/or Bluetooth communication protocols.

33. An antenna system for receiving and/or transmitting radio frequency signals in a predetermined frequency band, the antenna system comprising:

an antenna having first and second antenna portions electrically coupled together, the first antenna portion comprising at least one conducting loop about a first material having an initial permeability of at least 4, and the second antenna portion being embedded within a second material having a dielectric constant of at least 4;

a ground plane electrically connected to the antenna; and tuning circuitry having variable impedance and electrically coupled to the antenna so as to allow tuning the resonant frequency of the oscillatory system comprising the antenna, ground plane and tuning circuitry;

wherein the size of the antenna is such that the diameter of the smallest sphere which encloses all of the first and second antenna portions of the antenna is less than 1/30 of the wavelength of the radio frequency signals over the range of radio frequency signals at which the oscillatory system is resonant.

* * * * *